United States Patent [19]

Kikuchi et al.

[11] 4,065,275

[45] Dec. 27, 1977

[54] ELECTRIC DUST PRECIPITATOR

[75] Inventors: Yosio Kikuchi, Toyama; Noriyuki Miyabayashi, Kosugimachi; Masao Wada, Toyama, all of Japan

[73] Assignee: Nipponkai Heavy Industries Co., Ltd., Toyama, Japan

[21] Appl. No.: 705,935

[22] Filed: July 16, 1976

[51] Int. Cl.[2] ..... B03C 3/74

[52] U.S. Cl. ..... 55/121; 55/296

[58] Field of Search ..... 55/4, 13, 112, 121, 55/135, 296

[56] References Cited

U.S. PATENT DOCUMENTS

| | | | |
|---|---|---|---|
| 1,791,338 | 2/1931 | Wintermute | 55/121 |
| 2,497,171 | 2/1950 | Jones et al. | 55/13 |
| 2,503,617 | 4/1950 | Hamilton | 55/112 |
| 3,114,615 | 12/1963 | Lagarias | 55/121 |

FOREIGN PATENT DOCUMENTS

| | | | |
|---|---|---|---|
| 944,548 | 4/1949 | France | 55/135 |
| 1,457,107 | 1/1969 | Germany | 55/121 |
| 781,791 | 8/1957 | United Kingdom | 55/296 |

*Primary Examiner*—Frank W. Lutter
*Assistant Examiner*—David L. Lacy
*Attorney, Agent, or Firm*—Armstrong, Nikaido & Marmelstein

[57] ABSTRACT

An electric dust precipitator comprising a chamber; a pair of groups of dust collecting electrodes disposed in the chamber; a plurality of discharging wires disposed between the dust-collecting electrode groups, a high d.c. voltage being applied to the wires and electrodes; and two horizontal scraping means each of which includes two sliding bars, adapted to slide along opposite surfaces of the electrodes and having brackets at the inside thereof, and drawing plates, wherein ends of the drawing plates in pairs are pivotally mounted on the brackets and the other ends of the drawing plates in pairs are commonly suspended by chains, respectively, whereby the dust precipitated on the electrodes can be easily and completely removed by winding up the chains and hence moving up the scraping means.

13 Claims, 7 Drawing Figures

ELECTRIC DUST PRECIPITATOR

FIELD OF THE INVENTION

This invention relates to an electric dust precipitator, more particularly to an improved electric dust precipitator, in which dust precipitated on dust-collecting electrodes can be readily removed and the temperature of the dust-collecting electrodes can be precisely controlled.

BACKGROUND OF THE INVENTION

The electric dust precipitator, in principle, comprises a pair of opposite dust-collecting electrodes and a discharging wire disposed intermediately therebetween, which are positive and negative electrodes, respectively. When a high direct current voltage is applied between the electrodes and the wire, the electric field generated near the discharging wire is distorted so that a negative corona discharge may take place.

When a gas to be treated, for example, a waste gas containing smoke dust, is fed through the space between the dust-collecting electrodes and the discharging wire, i.e., through the discharging region, dust particles in the gas are negatively charged and then attracted to the dust-collecting electrodes.

The method for removing fine particles in the gas in accordance with the above-described principle is known to be highly effective for dust precipitation.

All the prior electric dust precipitators depend on the above principle, though modifications and variations are, of course, made in practice. One of the improvements is made in accordance with the removal of the dust precipitated on dust-collecting electrodes. Usually, the collected dust is removed in a mechanical manner. One method uses a hammer which shocks and vibrates the dust-collecting electrodes to knock off the collected dust. An alternate method uses a slider or scraper which moves along the surface of the dust-collecting electrodes to scrape off the dust.

The former method, however, has serious drawbacks. First of all, a shock wave caused by the hammer is so violent that beams supporting the electrodes tend to fail. Particularly, if the dust-collecting electrode is of a tubular type through which cooling water is passed, failure or cracks in the electrodes or joints between the electrodes and the beams (or headers) may result in leakage of water. Besides, the shock given by the hammer is partly absorbed by the cooling water within the tubular electrodes, resulting in insufficient vibration of the electrodes. Further, it is difficult to effectively knock off highly adhesive dust even at more accelerated vibrations of the hammer. Such insufficient removal of dust necessitates periodic suspension of operation to clear the electrodes.

In addition, the dust which has adhered to the electrodes instantaneously drops as soon as the hammer makes impact with the electrodes. Upon settling to the bottom, the dust disperses again, and as a result, dust in the discharging space between the dust-collecting electrodes instantaneously becomes a concentration several tens to several hundreds times higher than usual. The corona discharge in the relevant space is suppressed by such higher concentrations of dust that the dust-collecting capacity is reduced to a large extent, and the concentration of dust at the exit of the precipitator is temporarily increased.

The latter method which uses a sliding scraper can overcome the above-described drawbacks inherent in the hammering method, but it has its own disadvantage. The prior scraper is moved up and down in a sliding manner against the surface of the dust-collecting electrodes. The dust is not completely scraped off, however. Particularly when the sliding scraper is to be moved during operation, dust also precipitates onto the back of the scraper. Consequently, the operation must be suspended to remove the dust precipitated onto the back.

SUMMARY OF THE INVENTION

It is an object of this invention to provide an electric dust precipitator having an improved dust-scraping means in which the above-described disadvantages are eliminated and the dust precipitated onto dust-collecting electrodes can be easily removed.

According to this invention, there is provided an electric dust precipitator comprising a chamber; a pair of groups of dust-collecting electrodes disposed in parallel with each other in the gas-flow direction in the chamber and made of a tubular member through which a fluid for controlling the temperature thereof is passed; a plurality of discharging wires disposed parallel to and between the dust-collecting electrode groups, a high direct current voltage being applied to the discharging wires and the dust-collecting electrodes; two horizontal scraping means, each of which includes two sliding bars, adapted to slide along opposite surfaces of the electrodes and having opposed brackets at the inside thereof, and drawing plates, the ends of the drawing plates in pairs being pivotally mounted on the brackets and the other ends of the drawing plate pairs being commonly suspended by chains, respectively; and winders mounted above the top of the electrode groups for winding up the chains.

In a preferred embodiment of the invention, the brackets of the sliding bars and the other ends of the drawing plates are provided with pressure-adjusting means consisting of pairs of holes and pins which are respectively inserted therein.

In order that this invention may be more readily understood, reference will now be made to the accompanying drawings, in which.

Figure 5A:
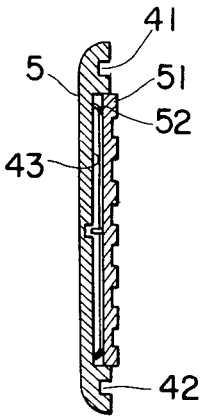
Figure 5B:
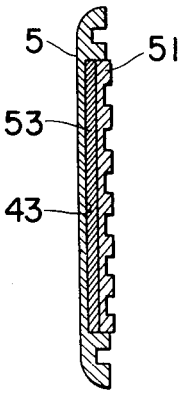
Figure 5C:
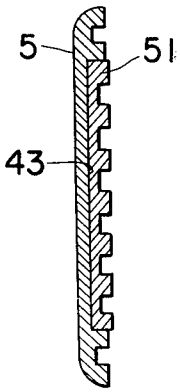

FIGS. 5-A to 5-C are vertical sectional views showing different embodiments of a sliding bar and a sliding block, respectively.

Figure 1:
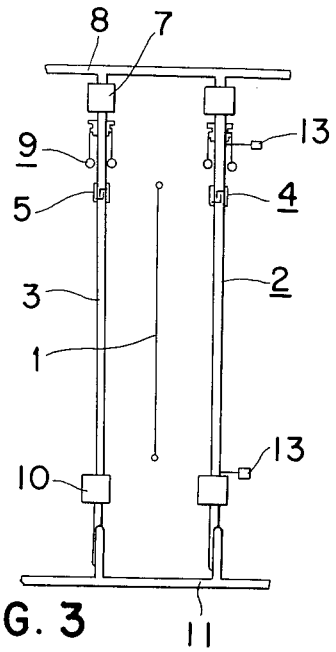
FIGS. 1 and 2 are a front and a side elevational view of a precipitator embodying the present invention, respectively.
Figure 2:
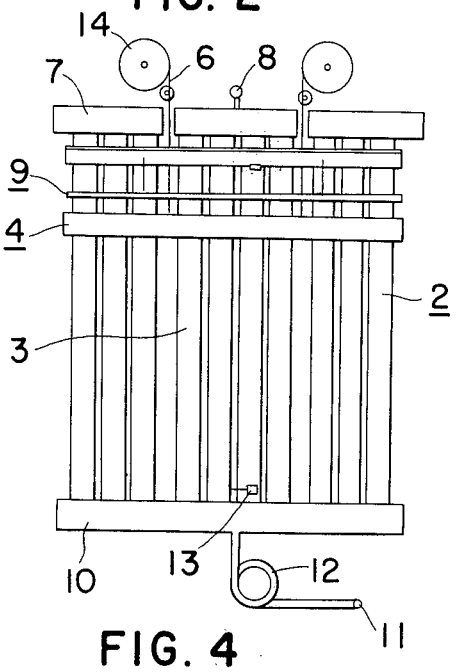

Referring to the drawing, the embodiment relating to the removal of the dust precipitated on dust-collecting electrodes will be described. In FIGS. 1 and 2, the electric dust precipitator of the invention comprises a plurality of discharging wires 1 and two rows or groups 2 of dust-collecting electrodes 3. The wires 1 are insulatedly supported and disposed in a straight line in a chamber defining a path for a gas to be treated. Two groups of dust-collecting electrodes 3 are in parallel with the direction of gas flow. Each electrode 3 is made of an elongated tubular member having a rectangular cross section. A high direct current voltage is applied between the wires 1 and the electrodes 3 to form a discharging space therebetween. The precipitator further comprises scraping means 4, each slidably mounted around each group 2 of the dust-collecting electrodes 3. Each scraping means 4 comprises a pair of split sliding bars 5.

Supporting means in the form of chains 6 in FIG. 2 are connected to the scraping means 4 to move the latter up and down, respectively. The chain 6 is vertically suspended between two adjacent electrodes in one group where the electrodes are spaced apart more than usual, (FIG. 2) or where an electrode to be aligned is omitted (not shown).

The chain 6 is connected to the scraping means 4 at a point about one quarter inside the respective ends of the scraping means (of the group 2) in the gas-flow direction. Flexural force applied on the sliding bar 5 is considerably reduced by mounting the chains 6 at such positions. The reduction of flexural force allows the sliding bar 5 to be thinner, thereby enabling a larger distance between the group 2. Because there is such little bending, the sliding bars 5 can slide along the surface of the dust-collecting electrodes 3 in close contact so as to scrape off the precipitated dust uniformly and thoroughly.

The chains 6 are wound up by winding machines 14, respectively, as shown in FIG. 2. Since the chains 6 are vertically extended through a space between adjacent electrodes 3 and the winding machines subsequently are placed above the groups 2 of the electrodes 3 inside the ends thereof, the length of the dust-collecting chamber in the gas-flow direction can advantageously be reduced. On the contrary, if chains are extended along the outsides of the groups of electrodes, and winding machines for winding up the chains subsequently are placed above the electrode groups at the outside ends thereof, a dust-collecting chamber in the gas-flow direction becomes longer because of the spaces occupied by the protruded winding machines. By placing the chains inside the ends of the groups, such an inconvenience can also be omitted.

The tubular dust-collecting electrodes 3 belonging to one group at the top are connected to a common upper header 7, which communicates with a common upper pipe 8.

The groups 2 of dust-collecting electrodes 3 at the upper portions are provided with cleaning means 9, respectively, which serve to remove the dust precipitated on the back of the scraping means 4. The cleaning means 9 is arranged so that it may slidably engage with the outside surface of the scraping means 5 when the latter is moved up. Upon engagement, the space between the discharging wire 1 and the dust-collecting electrode 3 is reduced, due to the scraping means 4 and the cleaning means 9 being interposed therebetween. This means that the insulating distance is undesirably reduced. To obviate the above drawback, the cleaning means 9 should be placed in the region having no or a weak electric field, in other words, at the upper portion of the electrode 3.

The tubular dust-collecting electrodes 3 belonging to one group at the bottom thereof are connected to a common lower header 10, which communicates with a common lower pipe 11 by way of a bent pipe 12 which can absorb the thermal expansion and contraction of the tubular electrodes 3. The electrodes in one group are further provided with a pair of switches 13 which abut on the ascended or descended scraping means 4 to subtain the further movement thereof.

The precipitator further comprises winding drivers 14 for winding up the chain 6, which are mounted above the top of the groups of electrodes.

Figure 3:
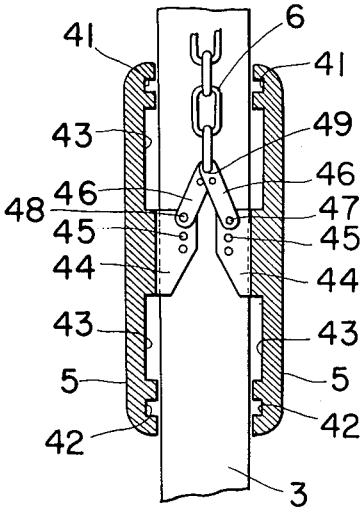
FIG. 3 is a vertical sectional view of a sliding means at the position where a chain is connected to the sliding means.

Another important feature of the invention relates to a suspending means for the scraping means 4, a partial sectional view of which is shown in FIG. 3. The dust-collecting electrode 3 is interposed between a pair of sliding bars 5 which are recessed at the inside thereof. Longitudinally continuous grooves 41 and 42 for relieving the scraped dust are formed at the upper and lower portions of the bars 5, respectively, and longitudinally continuous chambers 43 for accommodating sliding blocks (not shown; described in detail with reference to FIG. 5) therein are also formed at the center portion of the bars 5, respectively. At the position between adjacent electrodes where the chian 6 is interposed, the sliding bars 5 are provided with brackets 44 protruding inwardly, i.e., opposing each other. The brackets 44 have a pressure-adjusting means which consists of plural pairs, in this case three pairs of holes 45, aligned vertically. A pair of drawing plates 46 have a pair of holes 47 at the lower end, and plural pairs, in this case two pairs of longitudinally aligned holes 49 at the upper end. The drawing plates 46 are pivoted to the brackets 44 by inserting pins 48 in any desired pair of holes 45 in the brackets and the pair of lower holes 47 in the drawing plates 46, respectively. The chain 6 is connected to the drawing plates 46 by inserting an end member of the chain in any desired pair of holes 49 in the drawing plates 46 at a position remote from the lower holes 47. In FIG. 3, the end member of the chain 6 is inserted in the outside pair of holes 49.

The mechanism for adjusting pressure applied on the electrodes 3 by the sliding bars 5 is as follows. In FIG. 3 the pins 48 pivotally connecting the drawing plates 46 to the brackets 44 are inserted in the upper pair of holes 45. When the chain 6 is pulled upwardly, the drawing plates 46 are subjected to a force reducing the opening angle therebetween. In this case, particularly the upper portion of the sliding bars 5 is strongly pressed against the electrode 3, thereby enabling the dust to be scraped off quite effectively at the upper portion.

If the pins 48 are inserted in the middle pair of holes 45, the upper and lower portions of the sliding bars 5 are equally pressed. If the pins 48 are inserted into the lower pair of holes 45, particularly the lower portions are strongly pressed against the electrode 3.

In an alternative case, the end member of the chain 6 may be inserted into the inside pair of holes 49. The opening angle between the drawing plates 46 is larger, and as a result, the sliding bars 5 are pressed against the electrode 3 at a higher sliding pressure.

As is apparent from the above, the sliding bars 5 apply a variable sliding pressure to the electrode 3. In addition, the sliding bars 5 themselves are not restricted in the direction transverse to the electrode 3 so that they can follow the variation in height of the surface of the electrode 3 caused by the adhesion of dust. Therefore, the sliding bars smoothly slide along the electrode 3 and exhibit a uniform pressure to the latter. The contact surfaces of the sliding bars 5 are substantially parallel with the surfaces of the electrode 3, which ensures the smooth and uniform sliding movement. As a result, dust is uniformly removed to a minimal thickness from the surfaces of the electrode 3. Further, the sliding bars 5 are not subjected to localized force so that the abrasion of both the sliding bars 5 and the electrode 3 is negligible.

Figure 4:
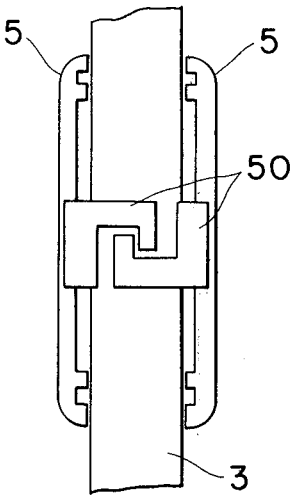
FIG. 4 is a front elevational view of a sliding means having spacers.

The sliding bars 5 at the outermost ends in the longitudinal direction are provided with spacers 50, respectively, as shown in FIG. 4. The spacers 50 engage each other to prevent the excessive approach and separation of the sliding bars.

FIGS. 5-A to 5-C show the cross-sections of sliding blocks to be received within the chamber 43 recessed in the sliding bar 5. Each sliding block is mounted separately in correspondence with each electrode. The separate sliding blocks mounted on the sliding bar make dust removal complete even when the electrodes have irregular surfaces.

In FIG. 5-A, a sliding block 51 made of abrasion-resistant metal is received within the chamber 43. A leaf spring 52 is placed between the wall of the chamber 43 and the back of the block 51. The interposition of the leaf spring 52 permits the sliding block 51 to slide in close contact with the electrode 3 regardless of the uneveness at the surface of the electrode 3.

An elastic member 53 made of heat-resistant rubber is employed in FIG. 5-B in place of the leaf spring 52. In FIG. 5-C a sliding block 51 made of heat-resistant rubber is employed. The elastomeric sliding block 51, of course, serves as a sliding block and an elastomer.

It is obvious that the sliding block 51 may be made of any suitable material such as phosphor bronze, copper, bronze, abrasion-resistant copper, metallic carbon, Teflon, abrasion-and heat- resistant synthetic resins and the like, depending on the conditions, including the temperature of the gas to be treated and the type of dust in the gas.

What is claimed is:

1. An electric dust precipitator comprising;

a pair of groups of dust-collecting electrodes disposed in parallel with each other in a chamber having a gas inlet and gas outlet;

a plurality of discharging wires disposed in parallel with and between said dust-collecting electrode groups, with a high direct current voltage being applied to said discharging wires and to said dust-collecting electrodes;

a horizontal scraping means being positioned around each of said groups and which includes a pair of sliding bars adapted to slide along opposite surfaces of said electrodes and having opposed brackets at the inside thereof, and a pair of drawing plates, one end of each of said drawing plates being pivotally connected to said brackets, and the other end of each of said drawing plates being commonly suspended by a chain;

and a winding means mounted above the top of said electrode groups for retracting said chain.

2. The precipitator according to claim 1 wherein said pair of brackets of the sliding bars are provided with a first pressure-adjusting means.

3. The precipitator according to claim 2 wherein said first pressure-adjusting means includes plural pairs of holes perforated in said pair of brackets and pins pivotally connecting said drawing plates to said pair of brackets.

4. The precipitator according to claim 1 wherein said other ends of the drawing plates are provided with a second pressure-adjusting means.

5. The precipitator according to claim 4 wherein said second pressure-adjusting means includes plural pairs of holes perforated in said plates and an end member of said chain inserted into said holes.

6. The precipitator according to claim 1 wherein said brackets of the sliding bars are provided with a first pressure-adjusting means and said other ends of the drawing plates are provided with a second pressure-adjusting means.

7. The precipitator according to claim 6 wherein said first pressure-adjusting means includes plural pairs of holes perforated in said pair of brackets and pins pivotally connecting said drawing plates to said pair of brackets, and said second pressure-adjusting means includes plural pairs of holes perforated in said plates and an end member of said chain inserted into said holes.

8. The precipitator according to claim 1 wherein longitudinal grooves for relieving scraped dust are formed at the inner surface of said sliding bar.

9. The precipitator according to claim 1 wherein a chamber is formed at the inner surface of said sliding bar and a sliding block is located in said chamber.

10. The precipitator according to claim 9 wherein said sliding block consists of a plurality of sliding block parts mounted separately in correspondence with said dust-collecting electrodes of said groups.

11. The precipitator according to claim 9 wherein said sliding block is pressed against said dust-collecting electrodes by means of a leaf spring interposed between the sliding block and a chamber wall of said chamber.

12. The precipitator according to claim 9 wherein said sliding block is pressed against said dust-collecting electrodes by means of an elastomer member interposed between the sliding block and the said chamber wall.

13. The precipitator according to claim 1 wherein said sliding bars at the longitudinally outermost ends thereof are provided with spacers engaging each other, respectively.

* * * * *